US006926630B2

(12) United States Patent
Yang

(10) Patent No.: US 6,926,630 B2
(45) Date of Patent: Aug. 9, 2005

(54) SEAMING STRUCTURE FOR USE IN BASEBALLS AND SOFTBALLS

(76) Inventor: Wen Shiang Yang, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/719,944

(22) Filed: Nov. 24, 2003

(65) Prior Publication Data

US 2005/0113196 A1 May 26, 2005

(51) Int. Cl.[7] ..... A63B 37/12
(52) U.S. Cl. ..... 473/598
(58) Field of Search ..... 473/600–602, 473/597, 598

(56) References Cited

U.S. PATENT DOCUMENTS 415,884 A * 11/1889 Shibe ..... 473/598
5,253,865 A * 10/1993 Kinnee ..... 473/598
5,772,544 A * 6/1998 Yang ..... 473/598
6,190,273 B1 * 2/2001 Maxey et al. ..... 473/598

* cited by examiner

*Primary Examiner*—Steven Wong

(57) ABSTRACT

A seaming structure using in baseballs and softballs is disclosed. Two covers including a first cover and a second cover close a ball core. A first seaming wire seams the two covers by alternatively passing through the two covers. Each of two upper seaming wires is arranged at an upper edge of one respective cover and is confined by a surface of the cover and the first seaming wire. Two lower seaming wires are similarly arranged, but they are arranged below the two covers. Moreover, a diameter of the upper seaming wires is equal to, great than or smaller than that of the lower seaming wires.

4 Claims, 8 Drawing Sheets

SEAMING STRUCTURE FOR USE IN BASEBALLS AND SOFTBALLS

FIELD OF THE INVENTION

The present invention relates to ball structures, and particular to a seaming structure using in baseballs and softballs, wherein the protrusions at edges of the covers of the ball is made by coarse wires so that the manufacturing process is easily, material used is saved, and cost is reduced.

BACKGROUND OF THE INVENTION

With reference to FIGS. 1 and 2, the prior art structure for baseballs and softballs is illustrated. Two covers 10*a*, 10*b* close the ball core 40 by using seaming wires 30. Each of the covers 10*a*, 10*b* has two large round portions at two ends and the middle portion connected to the two round portions are narrowed. At the edge of each cover 10*a*, 10*b* near the seaming portion is installed with a protrusion 20 so that the ball can be controlled preferably.

However, in the manufacturing process, the covers 10*a*, 10*b* must be made to have a shape matching the protrusions 20. Then the protrusions 20 must be glued into the lower sides of the covers 10*a*, 10*b* manually. Then the covers 10*a*, 10*b* are seamed by the seaming wires 30. The process is complicated and great work time is necessary. Moreover, the shape of the protrusion 20 must match the shape of the covers 10*a*, 10*b* so that a great part of the material for protrusions are wasted and thus cost is increased.

SUMMARY OF THE INVENTION

Accordingly, the primary object of the present invention is to provide a seaming structure using in baseballs and softballs, wherein the protrusions at edges of the covers of the ball is made by coarse wires so that the manufacturing process is easily, material used is saved, and cost is reduced.

To achieve above objects, the present invention provides a seaming structure using in baseballs and softballs. Two covers including a first cover and a second cover which close a ball core. A first seaming wire seams the two covers by alternatively passing through the two covers. Each of two upper seaming wires is arranged at an upper edge of one respective cover and is confined by a surface of the cover and the second seaming wire. Two lower seaming wires are similarly arranged, but they are arranged below the two covers. Moreover, a diameter of the upper seaming wires is equal to, great than or smaller than that of the lower seaming wires.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings 1 to 8 are only used to cause those skilled in the art to understand the objects, features, and characteristics of the present invention, but not to be used to confine the scope and spirit of the present invention defined in the appended claims. In the following, the present invention will be described herein with reference to FIGS. 1 to 8.

Figure 1:
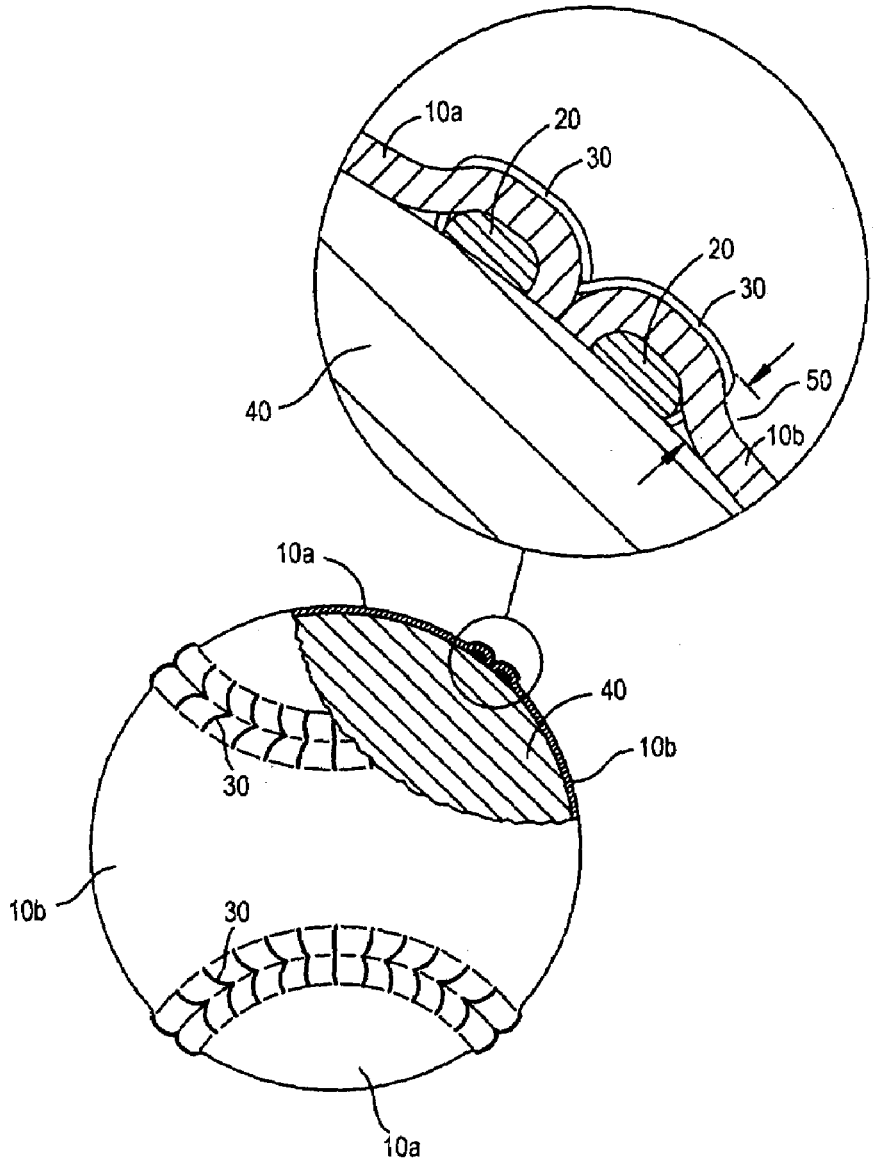
Fig. 1 (PRIOR ART)
FIG. 1 is a schematic view showing the structure of the prior art baseball or softball.
Figure 2:
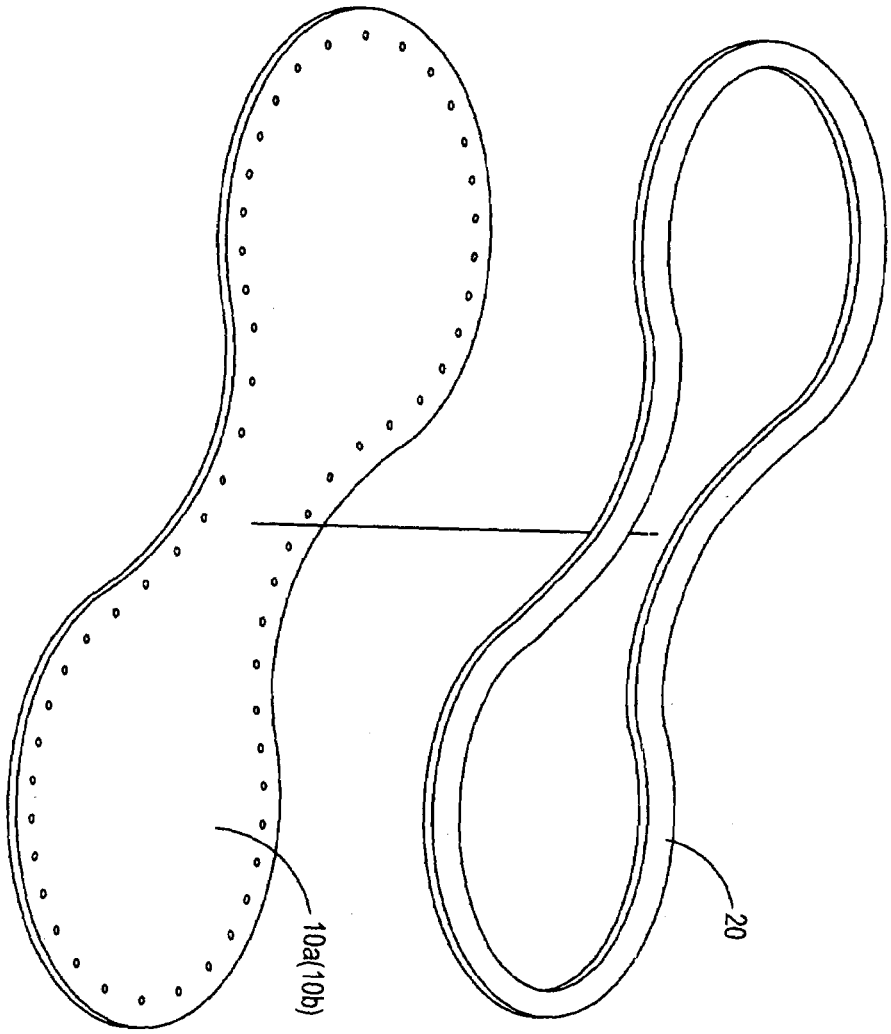
Fig. 2 (PRIOR ART)
FIG. 2 shows the seaming portion and arrangement of protrusion of the prior art illustrated in FIG. 1.
Figure 3:
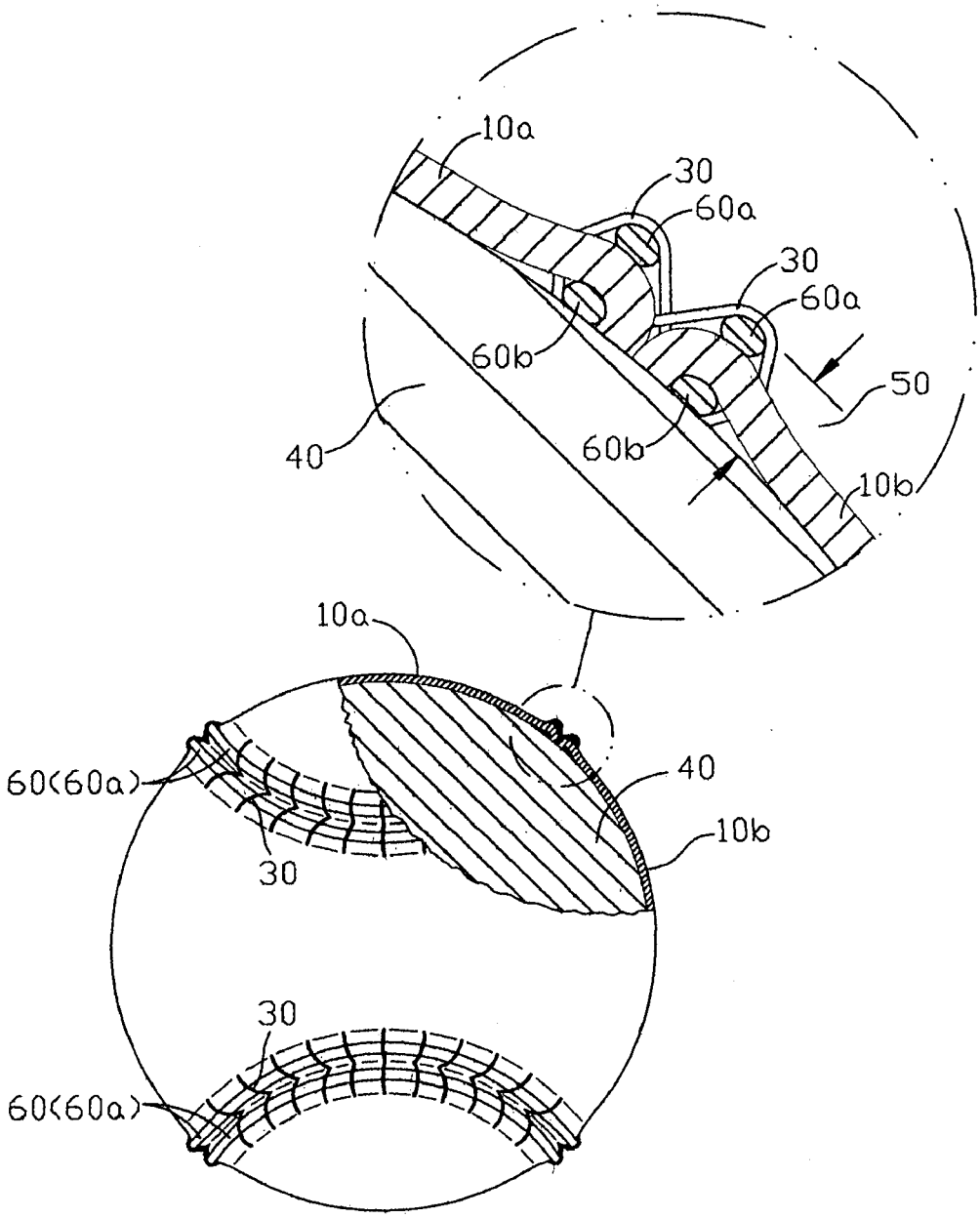
FIG. 3 is a schematic view showing the structure of the first embodiment of the present invention.
Figure 4:
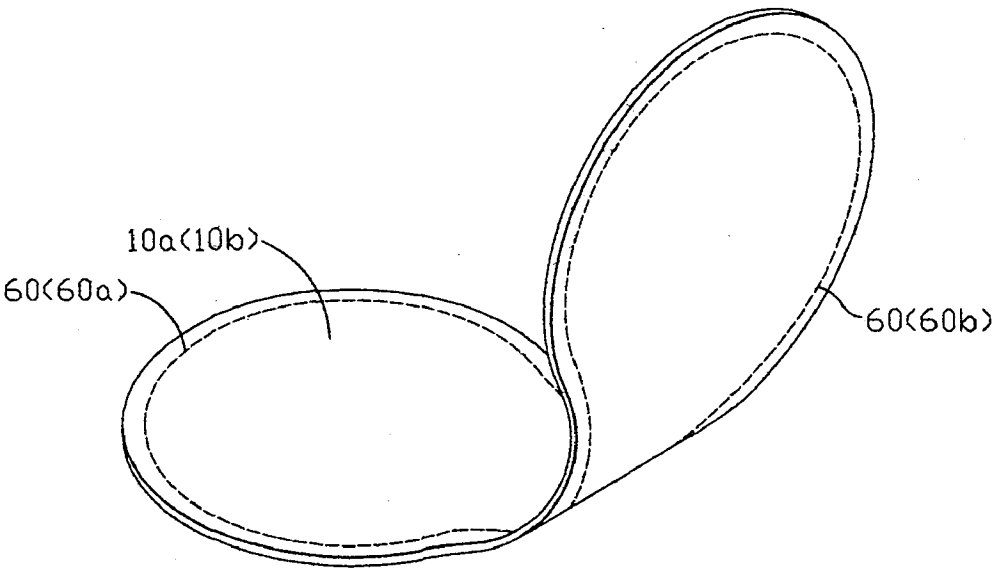
FIG. 4 is a schematic view showing the arrangement of the seaming wires in the first embodiment of the present invention.

With reference to FIGS. 3 to 4, the first embodiment of the present invention is illustrated. As above said prior art, in the present invention, two covers 10*a*, 10*b* which close the ball core 40 by using seaming wire 30. The other features of the present invention will be described here.

Each of the covers 10*a*, 10*b* has two large round portions at two ends and the middle portion connected to the two round portions are narrowed.

A first seaming wire 30 seams the two covers 10*a*, 10*b*. The first seaming wire 30 alternatively passes through the two covers 10*a*, 10*b*, that is, the first seaming wire 30 goes from one side of one of the two covers 10*a*, 10*b* to the other side of the cover and then enters to one side of the other cover and then passes through the other cover to the other side of the cover. The process is repeated until the edges of the two covers 10*a*, 10*b* are seamed.

Second seaming wires 60 including two upper seaming wires 60*a* and two lower seaming wires 60*b* serve to seam the two covers 10*a*, 10*b*. Each of the upper seaming wires 60*a* is arranged at an upper edge of one respective cover and is confined by the surface of the cover and the first seaming wire 30. Each of the lower seaming wires 60*b* is arranged at a lower edge of one respective cover and is confined by the surface of the cover and the first seaming wire 30. The upper seaming wires 60*a* and upper seaming wires 60*b* are made of wire with larger diameters. Thereby, the seaming portions of the covers 10*a*, 10*b* are formed as protrusions 50. Thus the holder has a preferred holding effect as he (or she) holds the ball.

Figure 5:
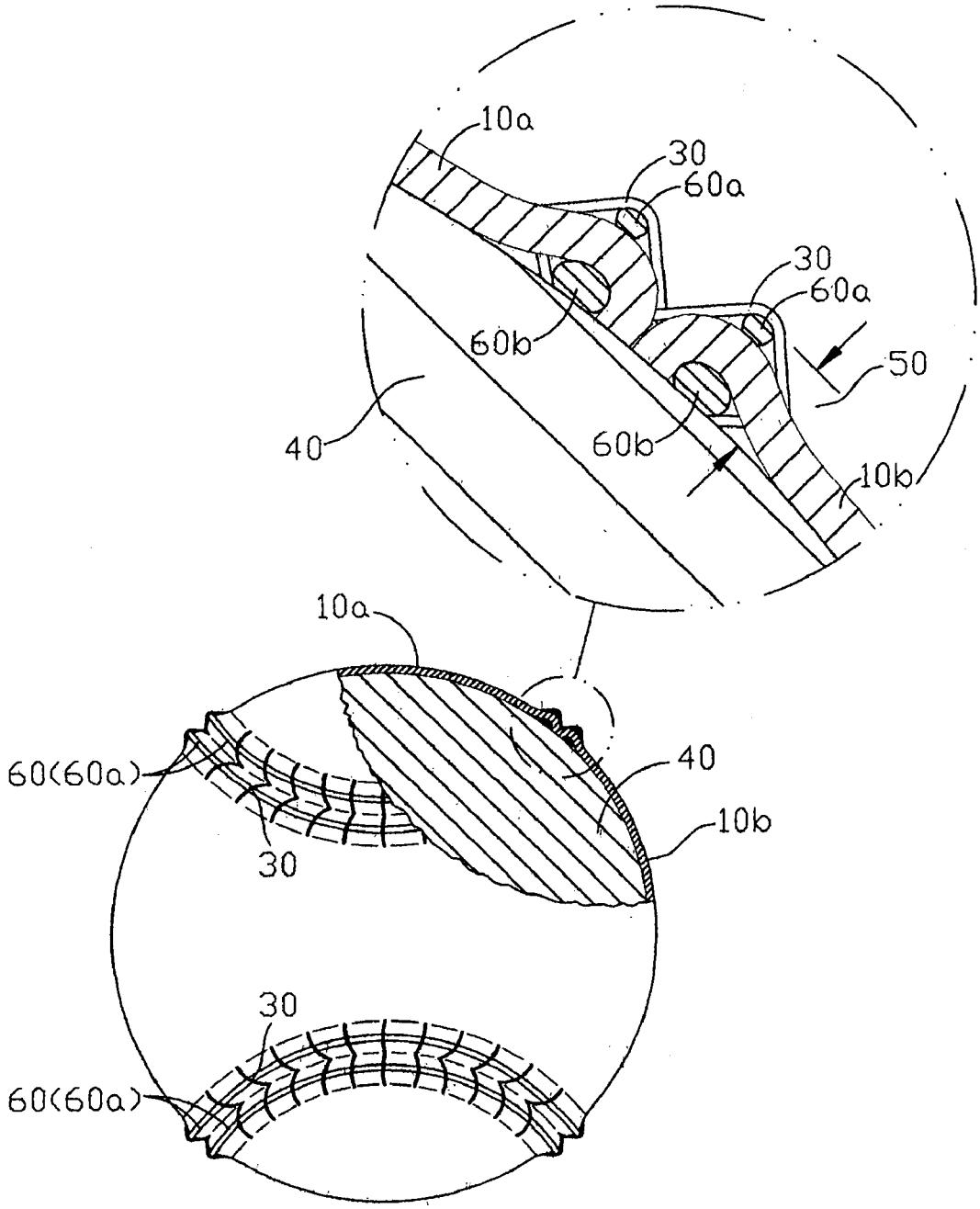
FIG. 5 is a schematic view showing the structure of the second embodiment of the present invention.
Figure 6:
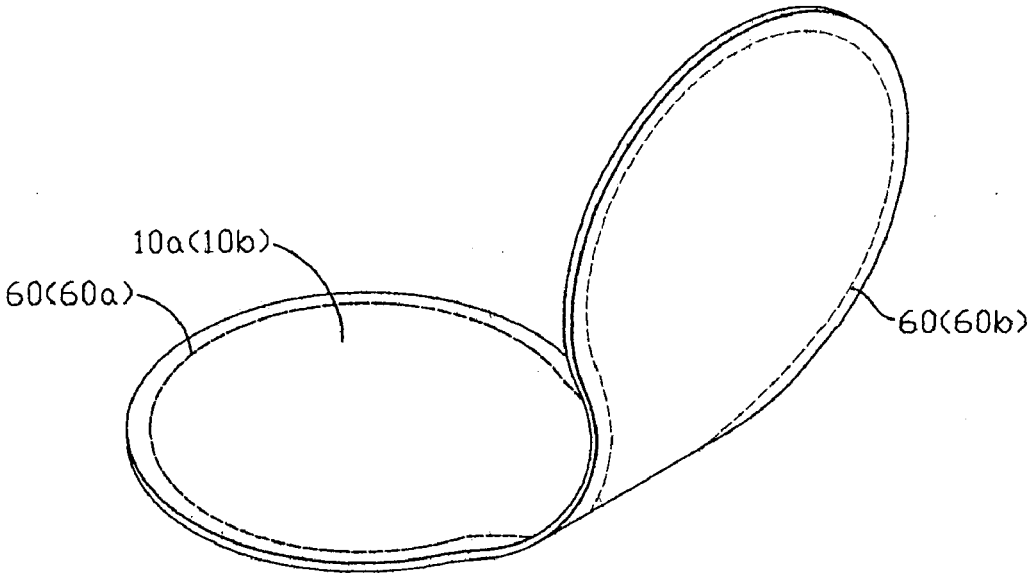
FIG. 6 is a schematic view showing the arrangement of the seaming wires in the second embodiment of the present invention.

Referring to FIGS. 5 and 6, the second embodiment of the present invention is illustrated. In this embodiment, all the components and arrangements of the ball are identical to those in the first embodiment. However, in the second embodiment, the diameter of the upper seaming wires 60*b* is larger than that of the upper seaming wires 60*a*.

Figure 7:
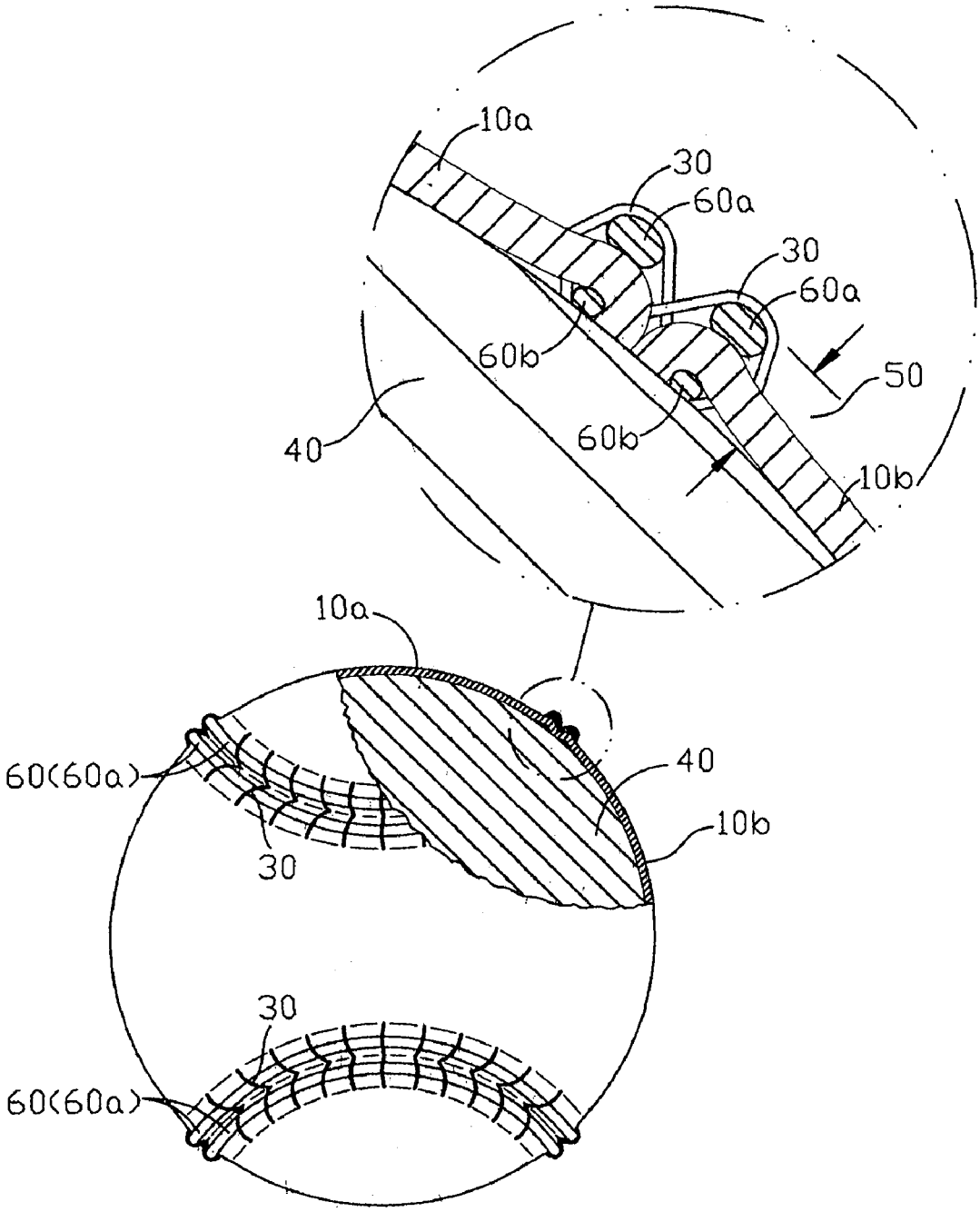
FIG. 7 is a schematic view showing the structure of the third embodiment of the present invention.
Figure 8:
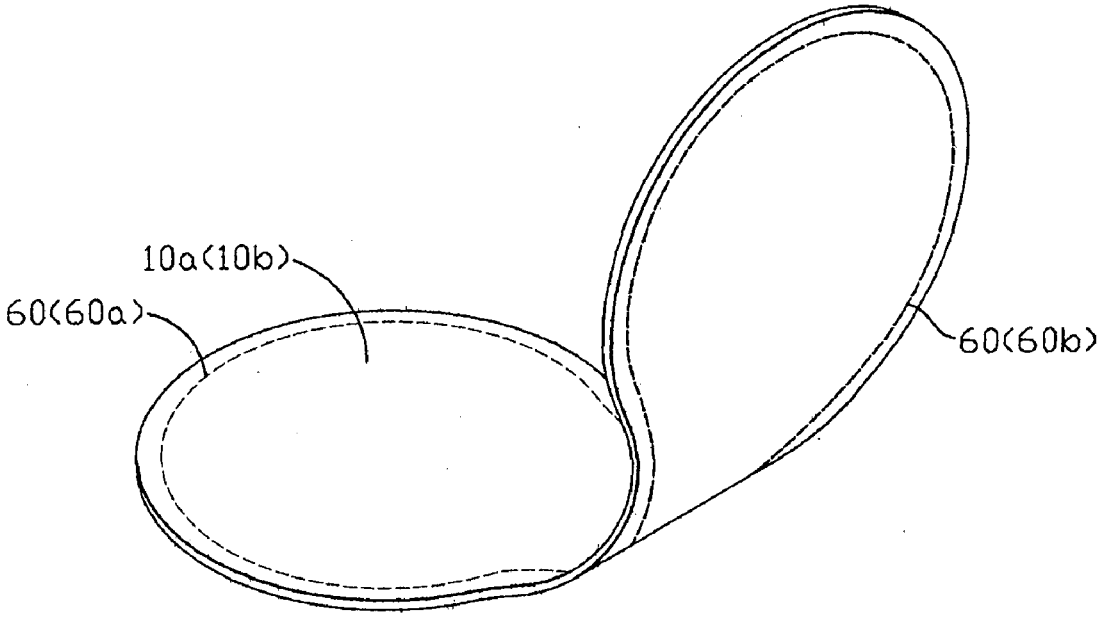
FIG. 8 is a schematic view showing the arrangement of the seaming wires in the third embodiment of the present invention.

Referring to FIGS. 7 and 8, the second embodiment of the present invention is illustrated. In this embodiment, all the components and arrangements of the ball are identical to those in the first embodiment. However, in the second embodiment, the diameter of the upper seaming wires 60*b* is smaller than that of the upper seaming wires 60*a*.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A seaming structure for use in baseballs and softballs comprising:

two covers including a first cover and a second cover which close a ball core; each of the covers having two ends with a large round portion at each end and a middle portion connected to the two round portions that is narrowed;

a first seaming wire seaming the two covers; the first seaming wire having a first diameter, the first seaming wire alternatively passing through the two covers, that is, the first seaming wire is arranged from a first side of the first cover to a second side of the first cover and then entering to a second side of the second cover to a first side of the second cover and then to the first side of the first cover; the process being repeated until the edges of the two covers being seamed;

two upper seaming wires, and two lower seaming wires serving to seam the two covers; each of the upper seaming wires being arranged at an upper edge of one respective cover and being confined by a surface of the respective cover and the first seaming wire; each of the lower seaming wires being arranged at a lower edge of one respective cover and being confined by a surface of the respective cover and the first seaming wire; the upper seaming wires and lower seaming wires being made of wires with larger diameters than the first diameter; thereby, the seaming portions of the covers are formed as protrusions;

wherein the edge of each cover is in contact to a surface of the ball core so as to separate the two upper seaming wires and two lower seaming wires.

2. Seaming structure as claimed in claim 1, wherein a diameter of the upper seaming wires is equal to that of the lower seaming wires.

3. The seaming structure as claimed in claim 1, wherein a diameter of the upper seaming wires is larger than that of the lower seaming wires.

4. The seaming structure as claimed in claim 1, wherein a diameter of the upper seaming wires is smaller than that of the lower seaming wires.

* * * * *